US005127966A

United States Patent [19]

Isobe et al.

[11] Patent Number: 5,127,966

[45] Date of Patent: Jul. 7, 1992

[54] METHOD OF PRODUCING HOT-DIP GALVANNEALED STEEL SHEET FREE OF TI WHITE-STRIPE DEFECTS

[75] Inventors: Makoto Isobe; Manabu Ohori; Koichi Hashiguchi; Koji Yamato, all of Chiba; Toshitake Hanazawa, Kurashiki, all of Japan

[73] Assignee: Kawasaki Steel Corp., Hyogo, Japan

[21] Appl. No.: 669,843

[22] Filed: Mar. 15, 1991

[30] Foreign Application Priority Data

Mar. 20, 1990 [JP] Japan ..... 2-71137

[51] Int. Cl.[5] ..... C23C 2/06; C22C 38/00

[52] U.S. Cl. ..... 148/533; 148/328; 428/659

[58] Field of Search ..... 148/12 F, 12 C, 12 D, 148/328, 12.1, 156; 428/659

[56] References Cited

U.S. PATENT DOCUMENTS 3,843,417 10/1974 Ohbu et al. ..... 148/12 D
4,168,972 9/1979 Dreulle ..... 428/659

FOREIGN PATENT DOCUMENTS 0211745 6/1988 Japan .
123058 5/1989 Japan .

*Primary Examiner*—R. Dean
*Assistant Examiner*—Sikyin Ip
*Attorney, Agent, or Firm*—Bierman and Muserlian

[57] ABSTRACT

A method of producing a hot-dip galvannealed steel sheet from a very-low-carbon cold-rolled steel sheet containing not less than 0.01 wt % but not more than 0.1 wt % of Ti, by subjecting the cold rolled steel sheet to a process conducted in a continuous hot-dip galvanizing system including a heat treatment, hot-dip galvanizing and a subsequent galvannealing. The method is characterized by the steps of: subjecting the cold-rolled steel sheet to a degreasing and an acid cleaning; subjecting the degreased and acid-cleaned steel sheet to a heat treatment conducted in a reducing gas atmosphere; and cooling the heat-treated steel sheet at a temperature not lower than 380° C. but not higher than the hot-dip galvanizing bath temperature, before the steel sheet is subjected to the hot-dip galvanizing. The very-low-carbon cold- rolled steel sheet contains, besides not less than 0.01 wt % but not more than 0.1 wt % of Ti, not more than 0.005 wt % of C, not less than 0.01 wt % but not more than 0.1 wt % of Al, not less than 0.01 wt % but not more than 0.1 wt % of Ti, and the balance substantially incidental inclusions and Fe.

15 Claims, No Drawings

METHOD OF PRODUCING HOT-DIP GALVANNEALED STEEL SHEET FREE OF TI WHITE-STRIPE DEFECTS

BACKGROUND OF THE INVENTION

1. Field of the Invention

The present invention relates to a method of producing a hot-dip galvannealed steel sheet. More particularly, the present invention is concerned with a method of preventing generation of white stripe defect which is often exhibited in production of hot-dip galvannealed steel sheet by using Ti-containing very-low-carbon cold-rolled steel sheet as the base material. This invention further provides a hot-dip galvannealed steel sheet having excellent corrosion resistance, weldability and press-workability.

2. Description of the Related Art

Hot-dip galvanized steel sheets generally exhibit superior corrosion resistance and, hence, have been used extensively in various fields. In particular, hot-dip galvannealed steel sheet, in which Fe of the base steel sheet has been diffused in the plating layer so as to be alloyed with Zn through a galvannealing subsequent to hot-dip galvanizing, exhibit superior spot-weldability and formability, as well as excellent corrosion resistance after painting, as compared with hot-dip galvanized steel sheet which has not been subjected to galvannealing. Due to such superior properties, hot-dip galvannealed steel sheets are finding spreading use, in particular in the field of inner and outer panels of automobiles.

Hitherto, very-low-carbon cold-rolled steel sheets, which excel in deep-drawability, have been used as the material of members which have to undergo a very severe forming work, e.g., inner and outer panels of automobiles. Some very-low-carbon cold-rolled steel sheets have been known having a basic composition obtained by minimizing the C content which impedes deep drawability and the minimized C content is fixed by addition of a trace amount of Ti with additive elements added for the purpose of improving strength and weldability.

An attempt has been made to produce a surface-treated steel sheet superior both in deep-drawability and corrosion resistance, by using a very-low-carbon cold-rolled steel sheet of the type mentioned above. For instance, Japanese Patent Laid-Open No. 1-184227 discloses a method of producing a hot-dip galvannealed steel sheet having excellent drawability.

Hitherto, a Sendzimir type plating line has been used in the production of hot-dip galvannealed steel. In this line, a steel sheet is quickly heated in a non-oxidizing furnace to burn and remove any grease on the steel sheet and is then subjected to a heating reduction conducted in a reducing atmosphere of an inert gas such as $H_2$ and $N_2$. The steel sheet is then introduced into a hot-dip galvanizing bath in which it is hot-dip galvanized. Then, the coating weight is adjusted through a gas-wiping and is heated by, for example, a cup burner so as to be alloyed, whereby a hot-dip galvannealed steel sheet is obtained.

According to this method, the steel sheet is made to pass through a non-oxidizing furnace which serves as a preheating furnace, prior to the heating reduction and annealing. Any grease on the steel sheet is removed by burning as the steel sheet passes through the non-oxidizing furnace, so that both pre-heating and cleaning of the steel sheet are conducted simultaneously to offer a high economy.

It has been found, however, a treatment of the aforementioned Ti containing very-low-carbon cold-rolled steel sheet in the above-mentioned plating line having a non-oxidizing furnace exhibit a surface defect in the form of white stripes which seriously degrade the appearance of the product sheet.

SUMMARY OF THE INVENTION

Accordingly, an object of the present invention is to provide a method of preventing generation of white stripe defect which is often exhibited in production of hot-dip galvannealed steel sheet by using Ti-containing very-low-carbon cold-rolled steel sheet as the base material. This invention further provides a hot-dip galvannealed steel sheet having excellent corrosion resistance, weldability and press-workability.

The present inventors have conducted an intense study to find the reason why surface defect in the form of white stripes is generated when a Ti-containing very-low-carbon cold-rolled steel sheet is subjected to hot-dip galvannealing, and have reached the following conclusion.

In general, Ti in a steel tends to be oxidized and concentrated to the surface region of the steel through formation of oxides.

More specifically, Ti segregated in the steel is elongated in the rolling direction when the steel sheet is rolled and is oxidized as a result of heating in the nonoxidizing furnace, so as to form striped local enrichment with Ti in the steel sheet surface. The tendency of local striped enrichment with Ti is enhanced when the steel sheet temperature is set high for the purpose of improving affinity of the steel sheet with the hot-dip galvanizing bath and increasing the plating efficiency.

The stripe local enrichment with Ti affects the reactivity between Al in the hot-dip galvanizing bath and the steel sheet during hot-dip galvanizing of the steel sheet. As a consequence, striped local variations are generated in the Fe-Zn-Al alloy phase which is generated in the interface between the Zn layer and Fe. During the subsequent galvannealing, the striped local variations of composition cause corresponding variations in the rate of diffusion of Fe into the Zn layer, so that corresponding local variations of alloying effect is caused to generate the white striped pattern on the surface of the steel sheet as the product.

The present invention is based upon the above-described discovery.

According to the present invention, there is provided a method of producing a hot-dip galvannealed steel sheet from a very-low-carbon cold-rolled steel sheet containing not less than 0.01 wt % but not more than 0.1 wt % of Ti, by subjecting the cold rolled steel sheet to a process conducted in a continuous hot-dip galvanizing line including a heat treatment, hot-dip galvanizing and a subsequent galvannealing, the method characterized by the steps of: subjecting the cold-rolled sheet to a degreasing and an acid cleaning; subjecting the degreased and acid-cleaned steel sheet to a heat treatment conducted in a reducing gas atmosphere; and cooling the heat treated steel sheet at a temperature not lower than 380° C. but not higher than the hot-dip galvanizing bath temperature, before the steel sheet is subjected to the hot dip galvanizing.

The very-low-carbon cold-rolled steel sheet containing not less than 0.01 wt % but not more than 0.1 wt % of Ti has one of the following compositions (I) to (VI)

(I) a composition containing not more than 0.005 wt % of C, not less than 0.01 wt % but not more than 0.1 wt % of Al, not less than 0.01 wt % but not more than 0.1 wt % of Ti, and the balance substantially incidental inclusions and Fe.

(II) a composition containing not more than 0.005 wt % of C, not less than 0.01 wt % but not more than 0.1 wt % of Al, not less than 0.01 wt % but not more than 0.1 wt % of Ti, not more than 0.001 wt % but not less than 0.05 wt % of Nb, and the balance substantially incidental inclusions and Fe.

(III) a composition containing not more than 0.005 wt % of C, not less than 0.01 wt % but not more than 0.1 wt % of Al, not less than 0.01 wt % but not more than 0.1 wt % of Ti, not less than 0.0002 wt % but not more than 0.003 wt % of B, and the balance substantially incidental inclusions and Fe.

(IV) a composition containing not more than 0.005 wt % of C, not less than 0.01 wt % but not more than 0.1 wt % of Al, not less than 0.01 wt % but not more than 0.1 wt % of Ti, not less than 0.001 wt % but not more than 0.05 wt % of Nb, not less than 0.0002 wt % but not more than 0.003 wt % of B, and the balance substantially incidental inclusions and Fe.

(V) a composition containing not more than 0.005 wt % of C, not less than 0.01 wt % but not more than 0.1 wt % of Al, not less than 0.01 wt % but not more than 0.1 wt % of Ti, not less than 0.02 wt % but not more than 0.1 wt % of P, not less than 0.0002 wt % but not more than 0.003 wt % of B, and the balance substantially incidental inclusions and Fe.

(VI) a composition containing not more than 0.005 wt % of C, not less than 0.01 wt % but not more than 0.1 wt % of Al, not less than 0.01 wt % but not more than 0.1 wt % of Ti, not less than 0.001 wt % but not more than 0.05 wt % of Nb, not less than 0.02 wt % but not more than 0.1 wt % of P, not less than 0.0002 wt % but not more than 0.003 wt % of B, and the balance substantially incidental inclusions and Fe.

The above and other objects, features and advantages of the present invention will become clear from the following detailed description of the invention.

DETAILED DESCRIPTION OF THE INVENTION

The steel sheet suitably used as the base material in the method of the present invention is a very-low-carbon cold-rolled steel sheet containing not less than 0.01 wt % but not more than 0.1 wt % of Ti. This is because the primary object of the present invention is to prevent generation of white stripe surface defect which is generated when steel sheet having such a Ti content is subjected to a hot-dip galvannealing.

A steel sheet having a Ti content falling within the range specified above is formed into a hot-dip galvannealed steel sheet through the steps of a heat treatment, galvanizing and galvannealing. As preparatory treatment, degreasing and acid cleaning are conducted in advance of the heat treatment.

Degreasing is necessary to clean the steel sheet surface so as to improve the efficiency of subsequent acid cleaning. The degreasing may be conducted by any known method such as alkali degreasing, electrolytic degreasing or by using a degreasing solvent. The acid cleaning is conducted for removing rusts on the steel sheet surface and, at the same time, for removing surface layer enriched with Ti and other elements. In order to satisfactorily remove rust and surface enriched layer, the acid cleaning is to be conducted to a degree of 0.2 $g/m^2$ or greater in terms of acid cleaning weight loss. Either a sulfuric acid bath or a hydrochloric acid bath is suitably used as the acid cleaning bath.

The degreased and acid-cleaned steel sheet is then subjected to a heat treatment which is conducted in a reducing gas atmosphere, without using a non-oxidizing furnace. This is because, if the heat treatment is conducted in a non-reducing atmosphere such as that in a non-oxidizing furnace, $H_2O$ is generated in the furnace as a result of burning of rolling oil, with the result that the steel sheet surface is oxidized to cause a Ti-enrichment in the surface region, thus impairing the effect of the acid cleaning.

The heat treated steel sheet as the base material is dipped in a hot-dip galvanizing bath. The temperature of the steel sheet entering the hot-dip galvanizing bath is preferably not lower than 380° C. but not higher than the hot-dip galvanizing bath temperature. The temperature of the hot-dip galvanizing bath is generally set to fall within the range of 440° and 500° C., in order to facilitate the adjustment of coating weight by wiping and in order to prevent evaporation scattering of Zn. When the temperature of the steel sheet entering the hot-dip galvanizing bath is below 380° C., plating failure tends to occur due to low affinity between the steel sheet and the hot-dip galvanizing bath. In addition, wiping is considerably hampered because the bath temperature is excessively lowered in the region around the steel sheet. By setting the temperature of the steel sheet entering the hot-dip galvanizing bath to a level not higher than the bath temperature, it is possible to reduce the saturation solubility of Fe-Al around the steel sheet so as to maintain an over-saturated state, whereby a uniform Fe-Al-Zn layer is precipitated before the reaction between the steel sheet and the hot-dip galvanizing bath, thereby suppressing generation of striped local variations of composition of the Fe Al-Zn layer in the plating.

The temperature of the steel sheet entering the hot-dip galvanizing bath is measured by a contact type thermometer or a non-contact type thermometer such as a radiation pyrometer, at a position between the outlet of the heat-treating annealing furnace and the hot-dip galvanizing bath. The measured temperature is delivered to a temperature controller which in turn delivers a signal to a gas flow-rate control valve which controls the flow rate of the gas, thereby allowing the control of temperature of the steel sheet entering the hot-dip galvanizing bath.

The hot-dip galvanizing bath should contain Al in an amount which is not less than 0.12 wt % but not more than 0.20 wt %. Al content of 0.12 wt % or more is effective in minimizing generation of Γ-phase which degrades the powdering characteristic of the hot-dip galvannealed sheet during hot-dip galvanizing and galvannealing. On the other hand, Al content exceeding 0.20 wt % seriously retards the alloying reaction between the plating layer and the steel, with the result that the production efficiency is lowered.

In the galvannealing conducted after the plating, the amount of diffusion of Fe into the plating layer should be not less than 7 wt % but not more than 12 wt %. Fe content in the plating layer below 7 wt % does not provide sufficient corrosion resistance, after painting, of the plating layer and impairs weldability. On the other hand, when the galvannealing is conducted to cause the Fe content of the plating layer to exceed 12 wt %, the rate of generation of Γ-phase at the interface between the plating layer and the steel becomes too large, with the result that the powdering characteristic of the hot-dip galvannealed steel sheet is undesirably impaired.

A description will now be given of the composition of the Ti-containing very-low-carbon steel which is suitable for use as the base material in the method of the present invention.

The Ti-containing very-low-carbon steel used in the present invention can have various composition systems which commonly contain C, Al and Ti. The contents of these common elements are limited as mentioned before for the following reasons.

C content is preferably minimized because C tends to impair deep-drawability (elongation, r value). Superior drawability is obtained when the C content is 0.005 wt % or less.

Al should be contained by 0.01 wt % or more in order to prevent loss of Ti due to oxidation. The addition of Al in excess of 0.1 wt %, however, is uneconomical because the effect of prevention of oxidation loss of Ti is saturated when the Al content exceeds this value.

Ti is added for the purpose of forming TiC and TiN so as to fix C and N which produce undesirable effects on drawability of steel. The effect of addition of Ti is not appreciable when the Ti content is below 0.01 wt %, whereas addition of Ti in excess of 0.1 wt % is uneconomical because of saturation of the effect of addition of Ti.

The effects produced by Nb, B and P which are contained in the aforementioned composition systems (II) to (VI), as well as reasons of limitation of their contents, will be described.

Nb is added for the purpose of eliminating anisotropy of elongation and r value of the steel sheet, thereby improving drawability. The effect of addition of Nb is not appreciable when the Nb content is below 0.001 wt %. On the other hand, addition of Nb in excess of 0.05 wt % is not preferred because the effect produced by Nb is uneconomically saturated and, rather, the elongation is decreased.

B improves brittleness and high-temperature strength of the steel, thus contributing to improvement in weldability. This element also prevents grain boundary segregation of P, thus suppressing embrittlement of the steel sheet caused by addition of P. The effect of addition of B, however, is not appreciable when the B content is below 0.0002 wt %, whereas, addition of B in excess of 0.003 wt % reduces the elongation and r value of the steel, thus impairing the performance.

P is an element which can strengthen the steel without adversely affecting the drawability. The effect of addition of P, however, is not appreciable when the P content is below 0.02 wt %. Addition of P in excess of 0.1 wt % is not preferred because the steel sheet is made too fragile.

EXAMPLES

Examples of the method of the present invention are shown below for an illustrative purpose.

EXAMPLE 1

Cold-rolled steel sheets (0.7 mm thick) having the compositions A to F shown in Table 1 were prepared. From these cold-rolled steel sheets, hot-dip galvannealed steel sheets were obtained through a process conducted under conditions shown in Table 2, including degreasing, acid cleaning, reducing annealing, hot-dip plating, adjustment of coating weight by wiping and galvannealing. Appearance of the plating, corrosion resistance, weldability and press-workability of these hot dip galvannealed steel sheets were evaluated on the following criteria.

(1) Appearance of Plating Layer

The produced steel sheets were visually checked at the outlet of the production line. The appearance of the plating layer was evaluated in terms of the ratio of the length of the zone having white stripe pattern to the entire coil length of the steel sheet. A mark ○ shows that the above-mentioned proportion of below 1%, while a mark Δ indicates that the proportion is not smaller than 1% but below 3%. Samples which showed plating failure of 3% or greater in terms of the above described proportion or samples which showed η-phase (pure zinc phase) due to insufficient alloying are marked by X.

(2) Corrosion Resistance After Painting

The produced zinc-plated steel sheets were subjected to a phosphatizing formation treatment, followed by cation electro-deposition painting conducted to provide a paint layer of 20 μm thick. The sample steel sheets were then cross-cut and subjected to a 480-hour salt spray test. The corrosion resistance was evaluated as follows on the basis of the width of the blister at the cross-cut portion.

| | |
|---|---|
| Blister width smaller than 2 mm | ○ |
| Blister width not smaller than 2 mm but below 4 mm | Δ |
| Blister width greater than 4 mm | X |

(3) Weldability

A spot welding was conducted by using a Cu-Cr alloy electrode having a rounded tip of 5 mm diameter. More specifically, the spot welding was conducted with a welding current of 10 kA, spotting speed of 1.5 spots/-second, an electrode force of 230 kgf, through 15 cycles of initial pressing, 12 cycles of electrical power supply and 3 cycles of holding. Then, three welded portion were delaminated for every 100 spots and the diameters of the nuggets were measured to examine if the diameters were greater than $4\sqrt{t}$ ("t" represents sheet thickness). By repeating said measuring tests, the weldability was evaluated as follows on the basis of the total number of the spots which continuously had nuggets diameter greater than $4\sqrt{t}$. spot numbers continuously exceeding $4\sqrt{t}$:

| | |
|---|---|
| 2000 or greater | ○ |
| 1200 or greater but below 2000 | Δ |
| below 1200 | X |

(4) Press workability

A flat-bottom cupping test was conducted by using a punch of 33 mm diameter. Drawing was conducted at a drawing ratio of 2.0 and the amount of delamination of the plating material per cup was measured and used as criterion of the press-workability.

| | |
|---|---|
| below 20 mg | ○ |
| 20 mg or more but below 60 mg | Δ |
| 60 mg or more or drawing impossible | X |

The results of the evaluation are shown in Table 2, from which it will be understood that the sample Nos. 1 to 6 of the hot-dip galvannealed steel sheet produced by the method of the present invention exhibit superior corrosion resistance, weldability and press-workability, and remarkably reduces generation of white stripe pattern defect, as compared with reference sample Nos. 1 to 8 of steel sheets.

As will be understood from the foregoing description, the method of the present invention makes it possible to eliminate generation of white stripe surface defect which hitherto has been unavoidable when a hot-dip galvanizing is conducted on a Ti-containing very-low-carbon cold-rolled steel sheet, while enabling production of steel sheets which are superior in corrosion resistance, weldability and press-workability. This broadens the use of Ti-containing very-low-carbon cold-rolled steel sheets which are inherently superior in deep-drawability, particularly in fields where a high corrosion resistance is required, thus offering a great industrial advantage.

TABLE 1

| Steel type | Composition (wt %) | | | | | | | | | |
|---|---|---|---|---|---|---|---|---|---|---|
| | C | Si | Mn | P | S | Al | Ti | Nb | B | N |
| A | 0.0021 | 0.01 | 0.15 | 0.009 | 0.008 | 0.038 | 0.032 | — | — | 0.0023 |
| B | 0.0023 | 0.01 | 0.15 | 0.008 | 0.007 | 0.042 | 0.031 | 0.005 | — | 0.0021 |
| C | 0.0021 | 0.01 | 0.14 | 0.009 | 0.008 | 0.037 | 0.031 | — | 0.0008 | 0.0024 |
| D | 0.0025 | 0.01 | 0.15 | 0.009 | 0.008 | 0.039 | 0.024 | 0.009 | 0.0007 | 0.0025 |
| E | 0.0022 | 0.01 | 0.15 | 0.072 | 0.007 | 0.043 | 0.034 | — | 0.0012 | 0.0026 |
| F | 0.0021 | 0.01 | 0.14 | 0.084 | 0.007 | 0.038 | 0.029 | 0.007 | 0.0010 | 0.0023 |

TABLE 2

| Sample Nos. | Type of steel | Degreasing method | Acid cleaning: Condition | Acid cleaning: Weight loss ($g/m^2$) | Heat-treat method | Bath entering temp. °C. | Bath temp. °C. |
|---|---|---|---|---|---|---|---|
| Sample No. 1 | A | Alkali | 5% Hcl, 60° C., 7 sec | 0.4 | reducing annealing | 452 | 470 |
| Sample No. 2 | B | Electrolysis | 5% Hcl, 60° C., 7 sec | 0.4 | reducing annealing | 431 | 470 |
| Sample No. 3 | C | Alkali | 5% $H_2SO_4$, 60° C., 7 sec | 0.4 | reducing annealing | 400 | 472 |
| Sample No. 4 | D | Alkali | 5% Hcl, 50° C., 6 sec | 0.3 | reducing annealing | 451 | 471 |
| Sample No. 5 | E | Alkali | 5% Hcl, 50° C., 6 sec | 0.3 | reducing annealing | 431 | 480 |
| Sample No. 6 | F | Alkali | 5% Hcl, 50° C., 6 sec | 0.3 | reducing annealing | 475 | 480 |
| Ref. Samp. No. 1 | A | — | — | — | Non-oxidizing + reducing annealing | 454 | 480 |
| Ref. Samp. No. 2 | B | Alkali | 5% Hcl, 40° C., 5 sec | 0.1 | reducing annealing | 451 | 471 |
| Ref. Samp. No. 3 | C | Alkali | 5% Hcl, 60° C., 7 sec | 0.4 | reducing annelaing | 365 | 471 |
| Ref. Samp. No. 4 | D | Alkali | 5% Hcl, 60° C., 7 sec | 0.4 | reducing annealing | 510 | 471 |
| Ref. Samp. No. 5 | E | Alkali | 5% Hcl, 50° C., 6 sec | 0.3 | reducing annealing | 460 | 472 |
| Ref. Samp. No. 6 | F | Alkali | 5% Hcl, 50° C., 6 sec | 0.3 | reducing annealing | 466 | 471 |
| Ref. Samp. No. 7 | A | Alkali | 5% Hcl, 50° C., 6 sec | 0.3 | reducing annealing | 430 | 480 |
| Ref. Samp. No. 8 | A | Alkali | 5% Hcl, 50° C., 6 sec | 0.3 | reducing annealing | 468 | 480 |

| Sample Nos. | Al content of bath | Fe diffusion in galvannealing (wt %) | Coating weight ($g/m^2$) | Plating appearance | Corrosion resistance after painting | Weldability | Press workability | Overall evaluation |
|---|---|---|---|---|---|---|---|---|
| Sample No. 1 | 0.13 | 11.2 | 47 | ○ | ○ | ○ | ○ | ○ |
| Sample No. 2 | 0.15 | 10.8 | 44 | ○ | ○ | ○ | ○ | ○ |
| Sample No. 3 | 0.15 | 9.6 | 51 | ○ | ○ | ○ | ○ | ○ |
| Sample No. 4 | 0.18 | 10.5 | 50 | ○ | ○ | ○ | ○ | ○ |
| Sample No. 5 | 0.15 | 9.3 | 52 | ○ | ○ | ○ | ○ | ○ |
| Sample No. 6 | 0.15 | 9.6 | 50 | ○ | ○ | ○ | ○ | ○ |
| Ref. Samp. | 0.15 | 10.2 | 48 | X | ○ | ○ | ○ | X |

TABLE 2-continued

| | | | | | | | | |
|---|---|---|---|---|---|---|---|---|
| No. 1 | | | | | | | | |
| Ref. Samp. No. 2 | 0.15 | 10.1 | 50 | Δ | ○ | ○ | ○ | Δ |
| Ref. Samp. No. 3 | 0.14 | 9.8 | 49 | X | ○ | ○ | ○ | X |
| Ref. Samp. No. 4 | 0.14 | 10.2 | 46 | X | ○ | ○ | ○ | X |
| Ref. Samp. No. 5 | 0.08 | 11.2 | 49 | ○ | ○ | ○ | X | X |
| Ref. Samp. No. 6 | 0.21 | 6.2 | 45 | X | Δ | Δ | ○ | X |
| Ref. Samp. No. 7 | 0.16 | 6.5 | 42 | X | Δ | Δ | ○ | X |
| Ref. Samp. No. 8 | 0.16 | 13.2 | 49 | ○ | ○ | ○ | X | X |

Note 1
Reducing annealing was conducted in 1000° C. $H_2$—$N_2$ atmosphere ($H_2$: 10%) having dewing point of −30° C.

What is claimed is:

1. A method of producing a hot-dip galvannealed steel sheet from a very-low-carbon cold-rolled steel sheet containing 0.01 wt % to 0.1 wt % of Ti free of white-stripe defects, by subjecting said cold rolled steel sheet to a process conducted in a continuous hot-dip galvanized line including a heat treatment, hot-dip galvanizing and a subsequent galvannealing, said method consisting essentially of the steps of: subjecting said cold-rolled steel sheet to a degreasing and an acid cleaning; subjecting the degreased and acid-cleaned steel sheet to a heat treatment conducted in a reducing gas atmosphere; and holding the heat-treated steel sheet at a temperature not lower than 380° C. but not higher than the hot-dip galvanizing bath temperature to form a uniform Fe-Al-Zn layer when hot-dip galvanizing, and then subjecting said steel sheet to hot-dip galvanizing to suppress white striped local variations of the Fe-Al-Zn layer form.

2. A method of producing a hot-dip galvanized steel sheet according to claim 1, wherein said acid cleaning is conducted at a rate not less than 0.2 g/m$^2$ in terms of acid-cleaning weight loss.

3. A method of producing a hot-dip galvannealed steel sheet according to claim 1, wherein said hot-dip galvanizing is conducted by using a hot-dip galvanizing bath containing not less than 0.12 wt % but not more than 0.20 wt % of Al.

4. A method of producing a hot-dip galvannealed steel sheet according to claim 1, wherein said very-low-carbon cold-rolled steel sheet containing not less than 0.01 wt % but not more than 0.1 wt % of Ti has a composition containing not more than 0.005 wt % of C, not less than 0.01 wt % but not more than 0.1 wt % of Al, not less than 0.01 wt % but not more than 0.1 wt % of Ti, and the balance substantially incidental inclusions and Fe.

5. A method of hot-dip galvannealed steel sheet according to claim 1, wherein said very-low-carbon cold-rolled steel sheet containing 0.01 wt % to 0.1 wt % of Ti has a composition containing not more than 0.005 wt % of C, 0.01 wt % to 0.1 wt % of Al, 0.01 wt % to 0.1 wt % of Ti, 0.001 wt % to 0.05 wt % of Nb, and the balance substantially incidental inclusions and Fe.

6. A method of producing a hot-dip galvannealed steel sheet according to claim 1, wherein said very-low-carbon cold-rolled steel sheet containing not less than 0.01 wt % but not more than 0.1 wt % of Ti has a composition containing not more than 0.005 wt % of C, not less than 0.01 wt % but not more than 0.1 wt % of Al, not less than 0.01 wt % but not more than 0.1 wt % of Ti, not less than 0.0002 wt % but not more than 0.003 wt % of B, and the balance substantially incidental inclusions and Fe.

7. A method of producing a hot-dip galvannealed steel sheet according to claim 1, wherein said very-low-carbon cold-rolled steel sheet containing not less than 0.01 wt % but not more than 0.1 wt % of Ti has a composition containing not more than 0.005 wt % of C, not less than 0.01 wt % but not more than 0.1 wt % of Al, not less than 0.01 wt % but not more than 0.1 wt % of Ti, not less than 0.001 wt % but not more than 0.05 wt % of Nb, not less than 0.0002 wt % but not more than 0.003 wt % of B, and the balance substantially incidental inclusions and Fe.

8. A method of producing a hot-dip galvannealed steel sheet according to claim 1, wherein said very-low-carbon cold-rolled steel sheet containing not less than 0.01 wt % but not more than 0.1 wt % of Ti has a composition containing not more than 0.005 wt % of C, not less than 0.01 wt % but not more than 0.1 wt % of Al, not less than 0.01 wt % but not more than 0.1 wt % of Ti, not less than 0.02 wt % but not more than 0.1 wt % of P, not less than 0.0002 wt % but not more than 0.003 wt % of B, and the balance substantially incidental inclusions and Fe.

9. A method of producing a hot-dip galvannealed steel sheet according to claim 1, wherein said very-low-carbon cold-rolled steel sheet containing not less than 0.01 wt % but not more than 0.1 wt % of Ti has a composition containing not more than 0.005 wt % of C, not less than 0.01 wt % but not more than 0.1 wt % of Al, not less than 0.01 wt % but not more than 0.1 wt % of Ti, not less than 0.001 wt % but not more than 0.05 wt % of Nb, not less than 0.02 wt % but not more than 0.1 wt % of P, not less than 0.0002 wt % but not more than 0.003 wt % of B, and the balance substantially incidental inclusions and Fe.

10. A hot-dip galvannealed steel sheet produced by the method of claim 1.

11. A hot-dip galvannealed steel sheet produced by the method of claim 5.

12. A hot-dip galvannealed steel sheet produced by the method of claim 6.

13. A hot-dip galvannealed steel sheet produced by the method of claim 7.

14. A hot-dip galvannealed steel sheet produced by the method of claim 8.

15. A hot-dip galvannealed steel sheet produced by the method of claim 9.

* * * * *